United States Patent [19]

Cundy

[11] 3,979,282

[45] Sept. 7, 1976

[54] FLOTATION OF FINE-GRAINED MATERIALS

[75] Inventor: Edwin K. Cundy, Cornwall, England

[73] Assignee: English Clays Lovering Pochin & Company Limited, Cornwall, England

[22] Filed: Jan. 16, 1975

[21] Appl. No.: 541,398

Related U.S. Application Data

[63] Continuation of Ser. No. 263,611, June 16, 1972, abandoned, which is a continuation-in-part of Ser. No. 803,875, March 3, 1969, abandoned.

[30] Foreign Application Priority Data

Mar. 11, 1968 United Kingdom ..... 11856/68

[52] U.S. Cl. ..... 209/166; 209/169

[51] Int. Cl.[2] ..... B03D 1/00

[58] Field of Search ..... 209/162–170

[56] References Cited

UNITED STATES PATENTS

| | | | |
|---|---|---|---|
| 2,073,148 | 3/1937 | Gayford | 209/164 |
| 2,569,680 | 10/1951 | Leek | 209/10 |
| 2,693,877 | 11/1954 | Drake | 209/169 X |
| 2,894,628 | 7/1959 | Duke | 209/166 |
| 2,944,802 | 7/1960 | Danan | 209/169 X |
| 3,202,281 | 8/1965 | Weston | 209/169 X |
| 3,224,582 | 12/1965 | Fannicelli | 209/166 |
| 3,302,785 | 2/1967 | Greene | 209/5 |
| 3,307,790 | 3/1967 | Cohn | 209/166 X |
| 3,353,668 | 11/1967 | Duke | 209/166 x |
| 3,378,141 | 4/1968 | Wauman | 209/169 |
| 3,450,257 | 3/1969 | Cundy | 209/166 X |

OTHER PUBLICATIONS

Chem Abst. 67, 1967, 92155 p.

*Primary Examiner*—Robert Halper
*Attorney, Agent, or Firm*—Stevens, Davis, Miller & Mosher

[57] ABSTRACT

A process for treating fine minerals, for example clays, to separate therefrom mineral impurities. The fine mineral is conditioned in the form of an aqueous slurry containing a deflocculant, for example sodium silicate, and a collector is added to the aqueous slurry of the mineral which is then subjected to a froth flotation process in a flotation cell having a central, internal, submerged impellor which comprises a base plate, to which there are attached a plurality of blades in radial arrangement, and a stationary cover plate which is separated from the tips of the blades by a small clearance, the impellor being rotated at a peripheral speed of at least 2000 feet/minute.

14 Claims, 2 Drawing Figures

FLOTATION OF FINE-GRAINED MATERIALS

This is a continuation, of application Ser. No. 263,611, filed June 16, 1972 now abandoned. Application Ser. No. 263,611 is in turn a continuation-in-part of my earlier U.S. Pat. application, Ser. No. 803,875 filed 3rd Mar. 1969 now abandoned.

BACKGROUND OF THE INVENTION

This invention relates to the processing of fine minerals i.e. minerals which consist substantially completely of particles smaller than 150 microns equivalent spherical diameter.

It is well known to remove impurities from minerals by forming the mineral into a slurry, conditioning the slurry and subjecting the conditioned slurry to a froth flotation process. In general, such a process comprises adding a collector, for example a long chain fatty acid, such as oleic acid, or an aliphatic amine containing from 8 to 20 carbon atoms, to the slurry of the mineral, conditioning the slurry by agitating the slurry in a tank, the conditioning generally being carried out for a time which results in the dissipation in the slurry of up to about 5 horsepower hours of energy per ton of solids, and then passing air through the slurry in a known manner in a froth flotation cell to effect a separation of impurities from the desired mineral. In most cases, the froth flotation process is carried out with the slurry at an alkaline pH and it may be advantageous to add an alkali, for example ammonium hydroxide, to the slurry before the conditioning thereof to ensure that the optimum pH conditions obtain. It is also well known to add a frothing agent, for example pine oil, to the conditioned slurry before carrying out the froth flotation process.

However, in many cases, and especially when treating fine minerals, it is found that the selectivity of the known processes is low, i.e. the proportion of the impurities removed is of the order of 50 percent or less. In addition some minerals, e.g. clays, naturally contain a high proportion, i.e. greater than 40 percent by weight, of particles of extremely small dimensions, i.e. two microns equivalent spherical diameter or smaller, and it is extremely difficult to separate impurities from such minerals by a simple froth flotation process of the type described above because the individual, extremely small particles of the mineral are grouped together into large masses and are flocculated, the impurities being included and held in the flocculated masses. In fact, in many industrial froth flotation processes the material consisting of particles smaller than 50 microns, which material takes the form of a slime, is separated from the crude ore and discarded. In order to try and overcome these problems it has been proposed to deflocculate the fine material, for example by the addition of a dispersing agent, e.g. sodium silicate, to the slurry, before treating the same by a froth flotation process. It has also been proposed to add an activator, for example a water-soluble salt of an alkaline earth metal, to the slurry before carrying out the froth flotation process. However, such processes still do not give wholly satisfactory results with slimes, and more recent attempts to try and beneficiate such materials have involved the use of auxiliary carrier particles which effectively increase the size of the mineral particles; processes of this type are disclosed, for example, in U.S. Pat. Specifications Nos. 2,990,958 and 3,224,582. However, these processes suffer from the drawback that they increase the cost of the product substantially and also introduce the risk of contaminating the desired mineral with auxiliary carrier particles thus necessitating a further separation step if the desired mineral is required in a pure state. This latter drawback arises because there is always the danger that some of the auxiliary carrier particles will not be sufficiently hydrophobic to float when introduced in the froth flotation process, even though the auxiliary carrier particles are intended to report to the froth together with the unwanted particles.

The prior art froth flotation processes described above have been carried out in a variety of types of froth flotation cell; one type of froth flotation cell which is frequently used comprises a central, internal, submerged impellor which is rotated at peripheral speeds up to about 1250 feet/minute.

SUMMARY OF THE INVENTION

It has now been discovered that the difficulties which arise when attempting to refine clays and other fine minerals, and particularly minerals which are natural slimes, by a froth flotation process are due at least in part to a potential energy barrier which prevents a mineral particle in the liquid phase of an aerated slurry entering the liquid/air interface. To overcome this problem it is proposed, in accordance with the present invention, to carry out the froth flotation process under conditions which ensure that the potential barrier between a particle and an air bubble is broken down. More particularly, according to the present invention there is provided a process for treating a fine mineral in order to separate therefrom mineral umpurities, which process comprises the steps of (a) conditioning the fine mineral in the form of an aqueous slurry containing a deflocculant; (b) mixing with the aqueous mineral slurry before or during the conditioning thereof a collector for the mineral impurities; (c) introducing the conditioned mineral slurry into a froth flotation cell having a central, internal, submerged impellor which comprises a base plate, to which there are attached a plurality of blades in radial arrangement, and a stationary cover plate which is separated from the tips of the blades by a small clearance; and (d) thereafter subjecting the conditioned mineral slurry to a froth flotation process in which the impellor of said froth flotation cell has a peripheral speed of at least 2,000 feet/minute.

DESCRIPTION OF THE PREFERRED EMBODIMENTS

Figure 1:
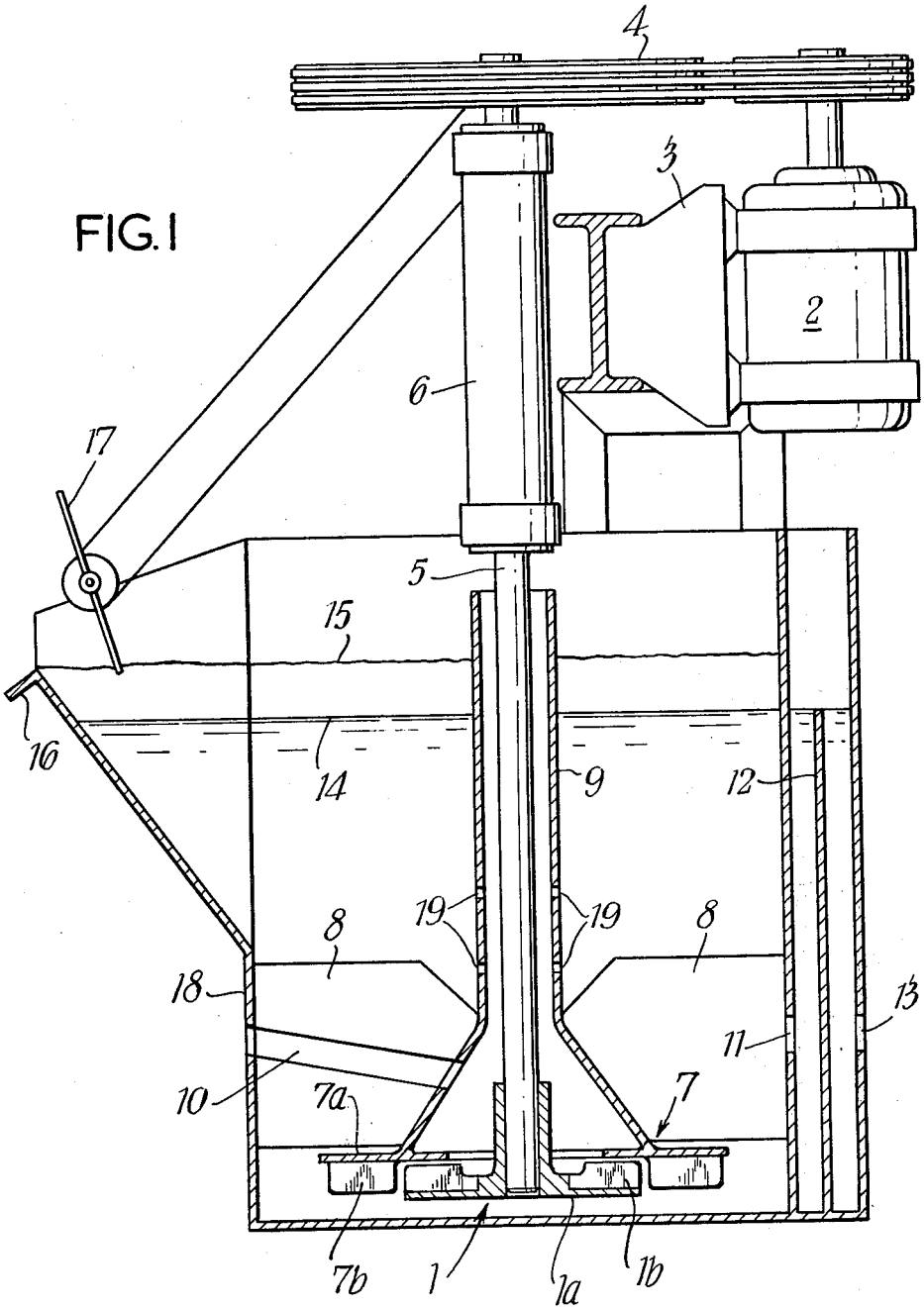

Advantageously, the peripheral speed of the impellor is at least 2,500 feet/minute but preferably does not exceed 3,000 feet/minute.

The process of the invention can be used with advantage for the treatment of fine minerals in general, i.e. minerals which consist substantially completely of particles smaller than 150 microns equivalent spherical diameter, but is especially useful for treating slimes, i.e. minerals consisting substantially completely of particles smaller than 50 microns, and more especially for minerals, such as kaolinitic clays, containing more than 40 percent by weight of particles smaller than 2 microns equivalent spherical diameter.

As with the known processes it may be advantageous to mix with the aqueous mineral slurry, before or during the conditioning thereof, (a) an alkali to raise the pH of the aqueous slurry to an alkaline value, e.g. about pH 9, and (b) an activator. In addition, in most cases, but not all, it is advantageous to add a frothing agent to the conditioned mineral slurry before carrying out the froth flotation process.

The method of the present invention has been found to be of particular value in the treatment of kaolinitic clays, but can also be employed in the treatment of other clays and to separate minor amounts of, for example, siliceous gangue from minerals such as gypsum, celestite, barite, calcite, dolomite, fluorspar, and phosphate ores, e.g. apatite. Many of these latter minerals, as mined, consist of particles larger than 50 microns, but it is often advantageous to grind such minerals until they consist mainly of particles smaller than 50 microns since this effects a better liberation of the impurities. Heretofore, the presence of particles smaller than 50 microns was undesirable in a froth flotation process for the reasons mentioned hereinbefore, but with the process of the present invention is is now possible to take advantage of having the feed in a finer state of division.

The conditioning step in the process of the invention is preferably carried out under conditions which ensure that a thorough scrubbing of the mineral particles is effected. More particularly, the conditioning of the aqueous mineral slurry is preferably carried out at a mineral solids content of at least 30 percent by weight and for a time sufficient to dissipate therein at least 25 horsepower hours of energy per ton of mineral solids. These conditions differ considerably from those conventionally employed wherein the energy dissipated in the slurry seldom exceeds 5 horsepower hours per ton of mineral solids. Preferably, in the process of the invention the conditioning is carried out at a solids content in the range of from 40 to 60 percent by weight.

In order to carry out the froth flotation process the conditioned clay slurry containing the frothing agent is introduced into a froth flotation cell having a central, internal, submerged impellor. By the term "impellor" there is meant herein a device which, in use, exerts a pumping action on pulp and/or air in a froth flotation cell. Such a device is distinct from other devices such as plane discs which have been employed in certain cells, for instance that described in U.S. Pat. Specification No. 2,073,148, but which exert no pumping action. The impellor used in the process of the invention comprises a base plate to which are attached upstanding or depending blades in radial arrangement. The base plate may be a flat disc or may be slightly dished. A stationary cover plate is also provided which is separated by a small clearance from the tips of the impellor blades. Preferably the impellor has upstanding blades and the stationary cover plate is mounted above the impellor, as with this arrangement when the impellor is stopped any coarse particles which settle out will do so on top of the stationary cover plate and will not foul the impellor. The cover plate is preferably of larger diameter than the impellor and the overlapping portion is preferably provided with a plurality of vanes or fins which extend so that their tips are approximately level with the periphery of the impellor base plate. An opening is provided at the centre of the upper member (whether the impellor or the cover plate) to permit the introduction of pulp and air to the centre of the impellor. The impellor arrangement just described is of the Fahrenwald type and is to be distinguished from impellor arrangements of the Fagergren type such as that described in U.S. Pat. Specification No. 3,353,668.

The impellor arrangement preferred for use in the process of the invention differs from that of the Fagergren type of cell in that the former has an impellor and cover plate while the Fagergren type has a rotor and stator, the stator being in the form of a cylindrical squirrell cage or perforated cylinder and the rotor comprising a second squirrel cage or a construction of spider-shaped cross section concentric with the stator. The cell used in the process of the invention draws in pulp and air at the centre of the impellor and constrains the two phases to flow concurrently through substantially enclosed channels which are defined by two adjacent radial impellor blades, the impellor base plate and the cover plate. Mixing takes place in the enclosed channels and in the horizontal zone surrounding the impellor and cover plate. In the Fagergren type cell mixing takes place only in a much more restricted area in the immediate vicinity of the annular space between the rotor and the stator. A further significant difference between the cell used in the process of the invention and one of the Fagergren type cell is that the former provides positive pull of pulp from other cells to the impellor without a special pumping system. This advantage is not possessed by the Fagergren cell. Furthermore, in the Fagergren type of cell the diameter of the rotor is generally approximately equal to its axial height but in the cell used in the process of the invention the diameter of the impellor is at least three times its axial height. This is necessary in order to provide the positive pumping action and the horizontal mixing zone surrounding the impellor and cover plate. A froth flotation cell of suitable basic construction in the Denver Sub-A machine shown on page 12 – 64 of the "Handbook of Mineral Dressing-Ores and Industrial Minerals" by Taggart, but the cell should be modified so that the impellor can rotate at the high speed essential for the process of the present invention. However, in the Examples set out below there were used flotation cells constructed substantially as shown in FIG. 1 of the accompanying drawings, the only difference between the various cells used in the Examples being the size. Referring to FIG. 1 of the accompanying drawings, it will be seen that the cell comprises an impellor 1 which comprises a base plate 1*a* to which there are attached a plurality of blades 1*b*, which impellor is driven by an electric motor 2, mounted on supporting steelwork 3, through an arrangement of belts and pulleys 4 and a vertical shaft 5 which rotates in a bearing 6. A stationary cover plate in the form of a hood 7 surrounds the impellor 1, and is supported by four diagonal baffles 8. The hood 7 is separated from the tips of the blades 1*b* of the impellor by a small clearance. The clearance will generally be from 1/24th to 1/30th the diameter of the impellor. Thus in a froth flotation cell of 56 inch diameter containing an impellor having a diameter of 30 inches, the clearance can be 1 inch. The hood 7 takes the form of an upper plate member 7*a* from which there depend a plurality of fins 7*b* which extend radially from a position adjacent to, but externally of, the periphery of the impellor to the periphery of the upper plate member 7*a*. The shaft 5 is surrounded by a cowling 9 which is attached to the hood 7 and the baffles 8. The feed of conditioned slurry is introduced into the cell by a pipe 10 which delivers the slurry to the inside of the cowling 9. The hood 7 is provided with a number of apertures so that the slurry can be drawn by the impellor 1 through the apertures. The cowling 9 is also provided with holes 19 whereby the slurry is circulated through the cowling 9. At the same time, air is drawn into the cell by the impellor 1 through the top of cowling 9. The machine discharge, or sink, material passes out of the cell through orifice 11 and over a weir 12, the height of which can be adjusted by adding or taking away wooden battens which slide in slots at each end; the machine discharge material finally leaves the cell by an orifice 13. The level of the conditioned slurry in the cell during operation is indicated at 14 and the top surface of the froth at 15. The froth is skimmed off over a lip 16 by means of a rotating paddle 17 driven through suitable gearing by the motor 2. The sides 18 of the cell are constructed of wood.

It is essential that the peripheral speed of the impellor be at least 2,000 feet/minute in order that sufficient momentum is given to a particle, by impact, to enable it to break through the energy barrier between it and an air bubble. The minimum peripheral speed for the impellor noted above is generally sufficient to ensure that the aeration rate of the cell is at least 0.6 cubic feet of air per minute per cubic foot of cell volume, but it is in addition advantageous if the aeration rate is increased to at least 0.8 cubic feet of air per minute per cubic foot of cell volume. The froth flotation process may be carried out in the absence of auxiliary carrier particles and without the use of pressurized air.

Figure 2:
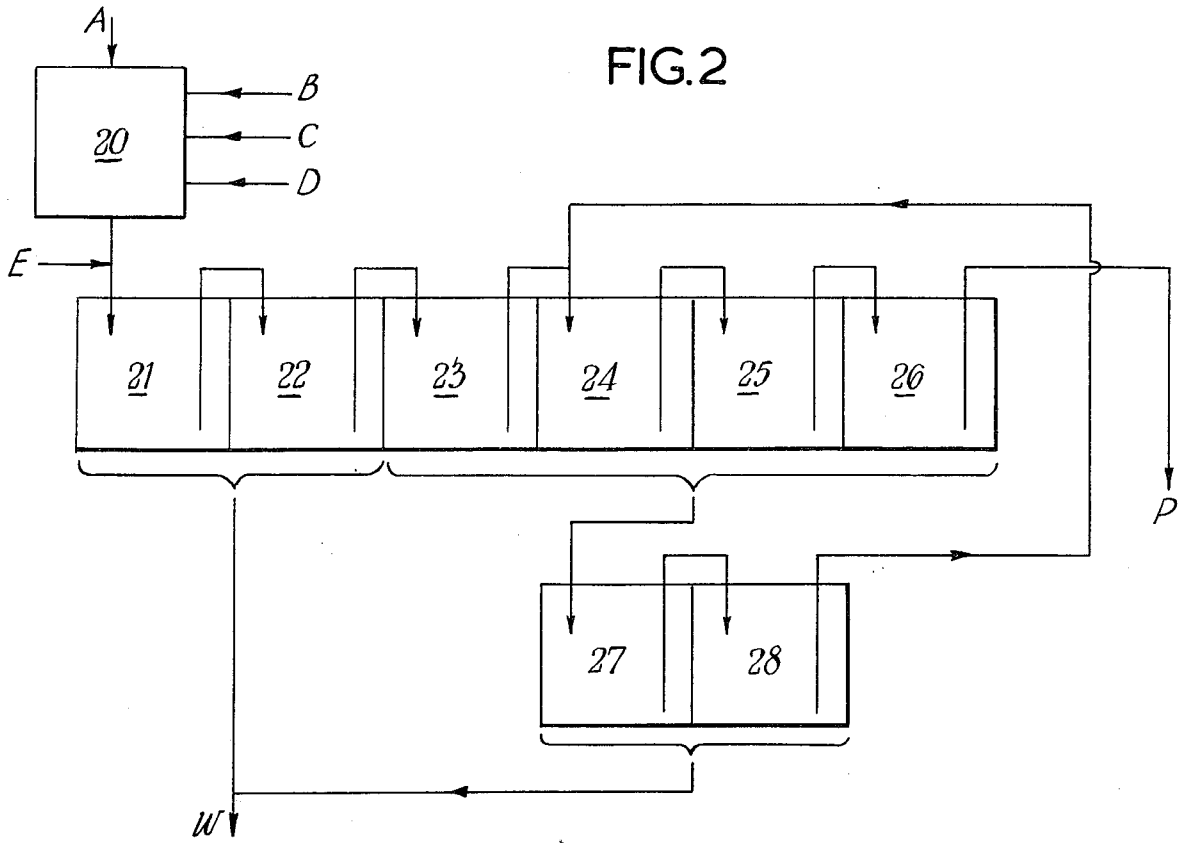

Although a good separation of the mineral impurities from the crude mineral may be achieved in a batch operation in one flotation cell, more of the impurities can be removed by operating continuously and connecting a number of similar flotation cells in series i.e. by feeding the machine discharge, or sink, material from the first cell to a second cell where further impurities are removed by the flotation process, and so on until the desired purity of the mineral is achieved. A diagram of a flotation plant suitable for performing such a process with, for example, a clay mineral is shown in FIG. 2 of the accompanying drawing wherein six similar cells 21 – 26, each of which is operated so that its impellor has a peripheral speed greater than 2500 ft/min., are connected in series and the machine discharge from cell 26 is the final purified product. A clay slurry, A, together with an alkali, B, a collector, C, and an activator, D, are fed to a conditioner 20 wherein the slurry is conditioned. After conditioning a frothing agent, E, is added to the slurry and the resulting mixture is fed to the first flotation cell 21. The float from cells 21 and 22 is discarded, but the float from cells 23 to 26 may be reflected in two cleaner cells 27 and 28 to release any clay which may have been carried over with the float. The machine discharge from cell 28 is mixed with the feed to cell 24 and the float from cells 27 to 28 is discarded. The total residence time of the clay in the plant is generally in the range 30 – 100 minutes.

All of the necessary quantities of the reagents is not necessarily added to the aqueous slurry of the mineral before the beginning of the froth flotation process. For example, in the treatment of a clay mineral there are employed, inter alia, a collector and activator and it is advantageous to add about one half of the required quantity of each of these reagents prior to initiating the flotation process; and, thereafter, during the flotation process, to add at intervals further smaller quantities of these reagents. The solids content of the conditioned slurry is, if necessary, adjusted to lie in the range 10 to 40 percent, preferably 15 to 30 percent, by weight before being fed to the froth flotation cell.

The specific conditions and materials giving the best results will vary to some extent according to the nature of the mineral being treated. The invention will now be described in greater detail with particular reference to the treatment of various minerals.

A. KAOLINITIC CLAY

In the treatment of clay minerals it is advantageous to condition the mineral slurry at a high solids content and for a time sufficient to dissipate therein at least 25 horsepower hours of energy per ton of mineral. It is essential that the conditioning of the slurry is carried out after a deflocculant has been added thereto but before a frothing agent, if used, is added thereto. The deflocculant can be, for example, sodium silicate in which case there will be used from 1.0 to 12.0 lbs per ton of dry clay. (It may be noted here that throughout this specification all "tons" are long tons of 2240 pounds).

Before or during the conditioning of the aqueous clay slurry, there should be added an alkali to raise the pH of the clay slurry to an alkaline value, perferably to about pH 9. The alkali used can be ammonium hydroxide although it will be appreciated that other alkalies may alternatively be used. In the case of ammonium hydroxide, there will generally be used from 2.0 to 5.0 lbs per ton of dry clay.

It is advantageous to use an activator which is preferably a water-soluble salt of an alkaline earth metal or a heavy metal (herein the term "alkaline earth metal" is to be understood to include magnesium, and the term "heavy metal" refers to metals having a specific gravity which is greater than 4); for example, there can be added as activator a water-soluble salt of barium, e.g. barium chloride, calcium, e.g. calcium chloride, cupric copper, ferrous iron, plumbous lead, e.g. lead acetate and lead nitrate, magnesium, manganous manganese, strontium or zinc. The amount of such an activator employed is generally in the range of from 0.2 to 2.5 lbs per ton of dry clay.

The collector for the mineral impurities can be, for example, a fatty acid containing from 8 to 20 carbon atoms and being saturated or having a low degree of unsaturation. Preferred collectors are oleic acid and lauric acid; in the former case there will generally be used from 1.5 to 7.5 lbs of oleic acid per ton of dry clay.

In the treatment of kaolinitic clays, it is also advantageous to use a frothing agent which can be, for example, pine oil, in which case there will generally be used from 0.5 to 2.5 lbs per ton of dry clay, or a lower alkyl ether of polypropylene glycol, such as that sold under the Trade Mark "DOWFROTH," in which case there will generally be used from 0.3 to 2.0 lbs per ton of dry clay.

After the aqueous clay slurry has been conditioned and before it is treated in the froth flotation cell it is advantageously diluted with water to a solids content of from 15 to 30 percent by weight.

The application of the method of the invention to the treatment of kaolinitic clays as illustrated by the following Examples 1 to 5. In the Examples, the efficiency of the separation process is measured by measuring the brightness of the clay product in terms of the percentage reflectance to light of a specific wavelength, the brighter the product the more efficient the process.

EXAMPLE 1

The experiments described in this Example were carried out on a degritted crude clay from Georgia, United States of America, with an initial brightness of 84 units and containing 45 percent by weight of particles smaller than 2 microns equivalent spherical diameter. The crude clay contained a quantity of titania as impurity. Samples of an aqueous slurry of the clay at varying clay solids contents were conditioned, using a flotation cell as shown in FIG. 1 of the accompanying drawings with its air intake closed, for a period of 45 minutes, the following reagents being added to the slurry before conditioning;

| Reagent | Quantity |
|---|---|
| Ammonium hydroxide | 4.1 pounds per ton of clay solids |
| Oleic acid | 4 pounds per ton of clay solids |
| Calcium chloride | 2.5 pounds per ton of clay solids |
| Sodium silicate | 4 pounds per ton of clay solids |

Thereafter the samples of conditioned slurry were diluted to 16 percent by weight clay solids and treated under similar conditions in the froth flotation cell mentioned above, the cell having a width of 6 inches and the impellor a diameter of 3 inches, and being worked, with its intake open at an impellor peripheral speed of 3000 ft/min. A further 2.5 lbs of oleic acid per ton of clay solids, and 0.1 lbs of pine oil per ton of clay solids, were added during the froth flotation process.

The brightness of the various samples after the froth flotation process in dependence upon the energy dissipated in the clay slurry during conditioning was found to be as given in Table 1 below:

TABLE I

| Clay solids content of slurry in percent by weight | Energy dissipated in clay slurry at end of 45 min — horsepower hours/ton of clay solids | Brightness of product after flotation |
|---|---|---|
| 10 | 4 | 87.5 |
| 20 | 9 | 88.1 |
| 30 | 14 | 88.5 |
| 40 | 19 | 88.7 |
| 50 | 23 | 89.1 |
| 60 | 28 | 89.5 |

EXAMPLE 2

Samples of the clay used in Example 1 were processed, using the same conditions as set forth in Example 1 but with a constant 40 percent clay solids content and varying conditioning times. The results set out in the following Table II were obtained for the brightness of the products after the froth flotation process.

TABLE II

| Conditioning time — minutes | Energy dissipated in clay slurry — horsepower hours/ton of clay solids | Brightness of product after flotation |
|---|---|---|
| 15 | 7 | 87.8 |
| 30 | 14 | 88.3 |
| 45 | 21 | 88.7 |
| 60 | 28 | 89.2 |

EXAMPLE 3

An aqueous slurry of the clay used in Examples 1 and 2 was conditioned for 45 minutes at a clay solids content of 50 percent, i.e. there was dispersed in the clay slurry 30 horsepower hours of energy per ton of clay. Thereafter samples of the conditioned slurry were diluted to 16 percent by weight clay solids and were subjected to a froth flotation process in a froth flotation cell constructed as shown in FIG. 1 of the accompanying drawings. The flotation cell has a capacity of 25 cubic feet and an impellor having a diamter of 18 inches, and the samples were treated at varying peripheral speeds of the impellor. The brightness of the finished product as a function of the peripheral speed of the impellor is given in Table III below.

TABLE III

| Impellor peripheral speed-ft/min | Aeration rate — cubic feet of air/min/cubic foot of cell volume | Product brightness |
|---|---|---|
| 1000 | 0.16 | 87.0 |
| 1500 | 0.28 | 87.6 |
| 2250 | 0.72 | 89.5 |
| 3000 | 1.6 | 90.2 |

EXAMPLE 4

A tourmaline-containing primary china clay having a particle size distribution such that 8 percent by weight consisted of particles greater than 10 microns in diameter and 55 percent by weight consisted of particles less than 2 microns in diameter was mixed with water to form a slurry containing 40 percent by weight clay solids. It may be noted here that tourmaline has a deep blue-black colour and hence impairs the brightness of any china clay in which it is present. Sodium silicate was then added to the suspension at the rate of approximately 4 lbs of sodium silicate per ton of clay in order to deflocculate the clay. The slurry was run into a laboratory flotation cell constructed as shown in FIG. 1 of the accompanying drawings and having a width of 6 inches and provided with an impellor having a diameter of 3 inches which rotated at a peripheral speed of 3000 ft/min., and the following reagents were added:

| Reagent | Quantity |
|---|---|
| Ammonium hydroxide | 1.2 lb per ton of dry clay |
| Oleic acid | 1.8 lb per ton of dry clay |
| Calcium chloride | 2.0 per ton of dry clay |

The pH of the slurry was 9.5. The slurry was conditioned in the presence of these reagents for 60 minutes using the impellor of the flotation cell but without allowing any air to be drawn into the cell. After conditioning, the slurry was diluted to 19 percent by weight clay solids. Pine oil at the rate of 0.6 lb per ton of dry clay was then added and the cell was run with the air intake open for 30 minutes, and the float and machine discharge were then examined. Table IV shows the brightness and tourmaline content of the feed and product.

TABLE IV

| | Brightness: % reflectance to light having wavelength of | | Tourmaline content | Tourmaline extraction efficiency |
|---|---|---|---|---|
| | 458 mμ | 574 mμ | % | |
| Feed | 85.5 | 90.0 | 0.80 | — |
| Product | 87.0 | 92.0 | 0.24 | 70% |

EXAMPLE 5

A tourmaline-containing primary china clay, having a particle size distribution such that 25 percent by weight consisted of particles greater than 10 microns in diamter and 42 percent by weight consisted of particles less than 2 microns in diameter, was mixed with water to form a slurry containing 40 percent by weight clay solids. Sodium silicate was then added to the slurry at the rate of approximately 1.0 lb of sodium silicate per ton of clay in order to deflocculate the clay. The slurry was run into a laboratory flotation cell similar in design to that shown in FIG. 1 of the accompanying drawings and having a width of 6 inches and a 3 inch diameter impellor which rotated at a peripheral speed of 3000 ft/min. The following reagents were added:

| Reagent | Quantity |
|---|---|
| Ammonium hydroxide | 4.1 lb per ton of dry clay |
| Oleic acid | 2.5 lb per ton of dry clay |
| Calcium chloride | 2.4 lb per ton of dry clay |

The pH of the slurry was 9.0. The slurry was conditioned in the presence of these reagents for 60 minutes using the impellor of the flotation cell but without allowing any air to be drawn into the cell. At the end of the conditioning period the slurry was diluted to 18 percent by weight of solids. Pine oil at the rate of 0.5 lb per ton of dry clay was then added and the cell was run with the air intake open for 30 minutes and the float and machine discharge were then examined. Table V shows the brightness and tourmaline content of the feed and product.

TABLE V

| | Brightness: % reflectance to light having wavelength of | | Tourmaline content | Tourmaline extraction efficiency |
|---|---|---|---|---|
| | 458 mμ | 574 mμ | % | |
| Feed | 79.5 | 83.5 | 2.8 | — |
| Product | 82.0 | 87.5 | 0.5 | 82% |

B. CELESTITE

In the treatment of celestite ores, the ore is advantageously conditioned by adding to an aqueous slurry containing at least 30 percent by weight of celestite ore a collector, an auxiliary oily reagent and a dispersing agent, and conditioning the slurry in the presence of the reagents for a time sufficient to dissipate in the slurry at least 25 horsepower hours of energy per ton of solids. The collector can be a sulphonated petroleum hydrocarbon of the green acid type, which is obtained in the refining of lubricating oils, or a salt or soap of such an acid. The amount of such a collector required is generally in the range from 0.1 to 5.0 lb per ton of ore and with most ores in the range from 0.2 to 3.0 lb per ton of ore. The auxiliary oily reagent may be any commercially available oil of animal, vegetable or mineral origin, but crude oil, paraffin and fuel oil are especially suitable. The amount required will generally be in the range from 0.1 to 2.5 lb per ton of ore and with most ores in the range from 0.5 to 1.5 lb per ton of ore. The dispersing agent is preferably sodium silicate and the amount required is generally in the range from 1.0 to 6.0 lb per ton or ore. The solids content of the aqueous slurry of celestite ore during the conditioning is preferably at least 40 percent by weight. No alkali need be added since the sodium silicate, being a salt of a weak acid and a strong base, is sufficient to render the aqueous slurry very slightly alkaline.

After the conditioning step, there is added to the conditioned slurry a frothing agent which may be, for example, pine oil. The quantity of pine oil required is in the range from 0.05 to 1.0 lb per ton of ore.

The conditioned aqueous slurry is then subjected to froth flotation in a flotation cell having a central, internal, submerged impellor which is capable of rotating at a peripheral speed of at least 2,000 feet per minute.

The application of the process of the invention to the treatment of celestite ores is illustrated by the following Example 6.

EXAMPLE 6

A sample, A, of celestite ore ($SrSO_4$) mined at Yate, Gloucestershire, England, and containing, as impurities, clays, ferruginous materials, silica and gypsun was ground to pass a No. 300 mesh B.S. sieve (nominal aperture: 53 microns) and mixed with water to form a slurry containing 40 percent by weight solids. To the slurry there were added 1 lb of a sodium petroleum sulphonate collector per ton of ore, 2 lb of sodium silicate per ton of ore and 1 lb of paraffin oil per ton of ore. The sodium petroleum sulphonate was that manufactured and sold by Cyanamid of Gt. Britain Ltd. under the trade name "AERO PROMOTEM 801." The slurry containing the reagents was conditioned in a tank provided with a high-speed propeller mixer for 30 minutes so that 30 horsepower hours of energy per ton of ore were dissipated in the slurry.

The conditioned slurry was diluted to 15 percent solids and transferred to a froth flotation cell constructed generally as shown in FIG. 1. The flotation cell had a capacity of 25 cubic feet and an impellor of diameter 18 inches rotating at a peripheral speed of 3000 ft/min. 0.1 lb of pine oil per ton of ore was added as a frother. In this process the sodium petroleum sulphonate renders the celestite hydrophobic in preference to the impurities. The celestite is thus removed in enriched form from the froth.

A second sample, B, of the same celestite ore, ground to pass a No. 300 mesh B.S. sieve, was enriched by a conventional froth flotation process. In this process the ground ore was mixed with water to form a slurry containing 25 percent by weight of solids. The same reagents in the same quantities were added to this sample as to the first sample, and the resulting slurry was conditioned in the same stirred tank for 10 minutes so that 5 horsepower hours of energy per ton of ore were dissipated in the slurry. The conditioned slurry was diluted to 15 solids and transferred to a froth flotation cell having a capacity of 25 cubic feet and an impellor of diameter 18 inches rotating at a peripheral speed of 1,250 ft/min. 0.1 pounds of pine oil per ton of ore was added as a frother.

The enriched celestite ore in the forth was separated and collected at the end of each "rougher" flotation stage and a sample of each froth product was taken for chemical analysis.

The remainder of froth product A was then returned to the conditioning tank and there were added to the slurry a further 0.4 lb of sodium petroleum sulphonate per ton of material, 1.5 lb of sodium silicate per ton of material and 0.5 lb of paraffin oil per ton of material.

The slurry was conditioned with the additional reagents for a further 30 minutes. It was not found necessary to add any more pine oil frother at this stage. The conditioned slurry was then returned to the flotation cell with the high speed impellor for a second or "cleaner" flotation stage at the end of which the further enriched celestite ore in the forth was separated and collected.

The remainder of froth product B was conditioned with the same additional reagents in the same quantities as froth product A but for a time of 10 minutes. The conditioned slurry was then subjected to froth flotation for a second time in the flotation cell with the lowspeed impellor at the end of which the further enriched celestite ore in the froth was separated and collected.

Table VI below shows the percentage of silica, ferric oxide and calcium oxide in the feed material and in the froth products obtained after the "rougher" and "cleaner" stages in the two treatments described above.

TABLE VI

| Material | $SiO_2$ (%) | $Fe_2O_3$ (%) | CaO (%) |
|---|---|---|---|
| Feed to Flotation processes | 1.2 | 0.49 | 0.98 |
| "Rougher" froth product from treatment A | 0.39 | 0.13 | 0.52 |
| "Rougher" froth product from treatment B | 0.78 | 0.23 | 0.72 |
| "Cleaner" froth product from treatment A | 0.12 | 0.04 | 0.25 |
| "Cleaner" froth product from treatment B | 0.30 | 0.12 | 0.52 |

C. APATITE

In the treatment of apatite ores, the ore is advantageously conditioned by adding to an aqueous slurry containing at least 30 percent by weight of apatite ore a collector, an auxiliary oily reagent and a dispersing agent, and conditioning the slurry in the presence of the reagents for a time sufficient to dissipate in the slurry at least 25 horsepower hours of energy per ton of solids. The collector is preferably a fatty acid having 8 to 20 carbon atoms in the hydrocarbon chain and being saturated or having only a low degree of unsaturation. The amount required is generally is the range from 0.1 to 5.0 lb per ton of ore and with most ores in the range from 0.5 to 4.0 lb per ton of ore. The auxiliary oily reagent can be any commercially-available oil of animal, vegetable or mineral origin, but crude oil, paraffin and fuel oil are especially suitable. The amount required will generally be in the range from 0.1 to 2.5 lb per ton of ore and with most ores in the range from 0.5 to 1.5 lb per ton of ore. The dispersing agent is preferably sodium silicate and the amount required is generally in the range from 1.0 to 6.0 lb per ton of ore. The solids content of the aqueous slurry of apatite ore during the conditioning is preferably at least 40 percent by weight. No alkali or activator is generally required.

The conditioned slurry is then subjected to froth flotation in a flotation cell having a central, internal, submerged impellor which is capable of rotating at a peripheral speed of at least 2,000 feet per minute.

The application of the process of the invention to the treatment of apatite ores is illustrated by following Example 7.

EXAMPLE 7

An apatite ore was first upgraded by a conventional grinding and classifying process and was then ground to pass a No. 300 mesh B.S. sieve (nominal aperture:53 microns). The finely ground material was then divided into two portions.

The first portion of finely ground apatite ore was mixed with water to form a slurry containing 40 percent by weight solids. To the slurry there were added 1 lb of oleic acid per ton of ore, 2 lb of sodium silicate per ton of ore and 1 lb of paraffin oil per ton of ore. The slurry containing the reagents was conditioned in a tank provided with a high-speed propellor mixer for 35 minutes so that 32 horsepower hours of energy per ton of ore were dissipated in the slurry. The conditioned slurry was diluted to 18 percent solids and transferred to a froth flotation cell constructed generally as shown in FIG. 1. The flotation cell had a capacity of 25 cubic feet and was provided with an impellor of diameter 18 inches rotating at a peripheral speed of 3000 ft/min. In this process it was found not to be necessary to add a frother. The apatite was rendered hydrophobic in preferance to the impurities and was therefore recovered in the froth product.

The second portion of the finely ground apatite ore was mixed with water to form a slurry containing 25 percent by weight of solids. The same reagents in the same quantities were added to this portion as to the first portion and the mixture was conditioned in the same stirred tank for 12 minutes so that 5 horsepower hours of energy per ton of ore was dissipated in the slurry. The conditioned slurry was diluted to 18 percent solids and transferred to a flotation cell having a capacity of 25 cubic feet and an impellor of diameter 18 inches rotating at a peripheral speed of 1250 ft/min. The enriched apatite was recovered in the froth product.

Table VII below shows the percentage of phosphorous pentoxide, ferric oxide, alumina, calcium oxide, fluorine and silica in the feed to the flotation processes and in the froth products obtained from the two treatments described above.

TABLE VII

| Material | $P_2O_5$ (%) | $Fe_2O_3$ (%) | $Al_2O_3$ (%) | CaO (%) | F (%) | $SiO_2$ (%) |
|---|---|---|---|---|---|---|
| Feed to flotation processes | 35.6 | 0.8 | 1.4 | 50.4 | 2.53 | 4.7 |
| Froth product from conventional process | 39.5 | 0.3 | 0.9 | 51.9 | 2.84 | 1.2 |
| Froth product from process of invention | 40.7 | 0.2 | 0.6 | 52.6 | 2.97 | 0.8 |

The significance of using an impellor of the type hereinbefore described, as opposed to an impellor of the Fagergren type, in the process of the invention is illustrated in the following Example 8.

EXAMPLE 8

Two identical samples of crude kaolin clay from Georgia, U.S.A. 60 percent by weight of the particles of which consisted of particles smaller than 2 microns equivalent spherical diameter and 17 percent by weight of the particles of which were larger than 10 microns equivalent spherical diameter were subjected to froth flotation in two different cells A and B. Cell A had an impellor and cover plate of the type employed in this invention and Cell B was of the Fagergren type. The dimensions of the cells are given in Table VIII below:

TABLE VIII

| Cell | Cell length and width inches | Cell depth ins. | Cell working volume cu. ft. | Impellor diameter inches | Impellor Speed r.p.m. | Peripheral speed ft/min. |
|---|---|---|---|---|---|---|
| A | 16 | 16 | 3.5 | 8 | 955 | 2000 |
| B | 20 | 11 | 1.41 | 7 | 1090 | 2000 |

The two samples of kaolin clay were each dispersed in water to form a suspension containing 60 percent by weight of solids, these being added as defloccutants, 1.25 g of sodium silicate per kilogram of dry clay (2.8 lb per ton) and 1.5 of ammonia per kilogram of dry clay (3.4 lb per ton). Oleic acid was then added in an amount equivalent to 1.25 g. per kilogram of dry clay (2.8 lb per ton). The mixture was agitated by means of a high speed impellor for a time sufficient to dissipate in the suspension a total energy of 30 horsepower hours per long ton of dry clay. After the conditioning step the suspension was diluted with water to 21 percent by weight of solids and subjected to froth flotation for a total time of 60 minutes. At the end of this time the machine discharge product which comprised purified clay was tested for percentage reflectance to light of 458 nm and 574 nm wavelength respectively and analysed for $TiO_2$ and $Fe_2O_3$ content. The percentage recovery of kaolin clay in the machine discharge product and the percentage of $TiO_2$ and $Fe_2O_3$ removed by the flotation process were calculated. The results are shown in Table IX below:

TABLE IX

| Cell | Kaolin recovery % | % reflectance to light of wavelength 458 nm | 574 nm | $TiO_2$ removal % | $Fe_2O_3$ removal % | Temperature rise °C |
|---|---|---|---|---|---|---|
| A | 88.7 | 87.8 | 93.3 | 63 | 12 | 7 |
| B | 90.1 | 85.2 | 91.5 | 47 | 11 | 4 |

With the cell in accordance with the invention the recovery of kaolin was slightly lower but the quality of the purified kaolin was very much better. It was also observed that with Cell B the low pulp depth gave a turbulent surface and there was little control over the amount of air and excessive turbulence during the initial stages of flotation. By contrast, with Cell A sufficient depth of froth was built up to allow kaolin particles to drain from the froth, and a more clearly defined froth/pulp interface made a cleaner removal of the froth product possible. In addition, it can be seen by comparing the figures for the rise in temperature of the pulp during the two flotation operations that more energy is dissipated in the pulp in cell A than in cell B. When oleic acid is used as a collector in the type of flotation process described in this specification it has been found that the efficiency of the separation is increased when more energy is dissipated in the pulp.

I claim:

1. A process for treating a fine mineral consisting substantially completely of particles smaller than 50 microns equivalent spherical diameter in order to separate therefrom mineral impurities, which process comprises the steps of (a) conditioning the fine mineral in the form of an aqueous slurry, having a solids content of at least 30 percent by weight and containing a deflocculant, for a time sufficient to dissipate therein at least 25 horsepower hours of energy per ton of mineral solids; (b) mixing with the aqueous mineral slurry before or during the conditioning thereof a collector; (c) introducing the conditioned mineral slurry into a froth flotation cell having a central, internal, submerged impeller which comprises a base plate, to which there are attached a plurality of blades in radial arrangement, and a stationary cover plate separated from the tips of the blades by a small clearance; and (d) thereafter subjecting the conditioned aqueous mineral slurry to a pumping action in a froth flotation process in which the impeller of said froth flotation cell has a peripheral speed of at least 2,000 feet/minute and in which the aeration rate is at least 0.8 cubic feet of air per minute per cubic foot of froth flotation cell volume.

2. A process according to claim 1, wherein said impeller has a peripheral speed of at least 2,500 feet/minute.

3. A process according to claim 1, wherein the impeller has a diameter which is at least three times its axial height.

4. A process according to claim 1, wherein the fine mineral is conditioned as an aqueous slurry having a solids content in the range 40 percent to 60 percent by weight.

5. A process according to claim 1, wherein the fine mineral is a kaolinitic clay.

6. A process according to claim 1, wherein the conditioned mineral slurry is introduced into the froth flotation cell at a solids content in the range 15 percent to 30 percent by weight.

7. A process according to claim 1 for treating a fine mineral consisting substantially completely of particles smaller than 50 microns equivalent spherical diameter in order to separate therefrom mineral impurities, which process comprises the steps of (a) conditioning the fine mineral in the form of an aqueous slurry, having a solids content of at least 30 percent by weight and containing a deflocculant, for a time sufficient to dissipate therein at least 25 horsepower hours of energy per ton of mineral solids; (b) mixing with the aqueous mineral slurry before or during the conditioning thereof a collector; (c) diluting the conditioned mineral slurry to a solids content in the range 15 to 30 percent by weight; (d) introducing the diluted, conditioned mineral slurry into a froth flotation cell having a central, internal, submerged impeller which comprises a base plate, to which are attached a plurality of blades in radial arrangement, and a stationary cover plate separated from the tips of the blades by a small clearance; and (e) thereafter subjecting the conditioned aqueous mineral slurry to a pumping action in a froth flotation process in which the impeller of said froth flotation cell has a peripheral speed of at least 2,500 feet/minute and in which the aeration rate is at least 0.8 cubic feet of air per minute per cubic foot of froth flotation cell volume.

8. A process according to claim 7, wherein the impeller has a diameter which is at least three times its axial height.

9. A process according to claim 7, wherein the fine mineral is conditioned as an aqueous slurry having a solids content in the range 40 to 60 percent by weight.

10. A process according to claim 1 for treating a fine mineral consisting substantially completely of particles smaller than 50 microns equivalent spherical diameter in order to separate therefrom mineral impurities, which process comprises the steps of (a) conditioning the fine mineral in the form of an aqueous slurry containing a deflocculant, the aqueous slurry having a solids content in the range 40 to 60 percent by weight, for a time sufficient to dissipate therein at least 25 horsepower hours of energy per ton of mineral solids; (b) mixing with the aqueous mineral slurry before or during the conditioning thereof a collector; (c) diluting the conditioned mineral slurry to a solids content in the range 15 to 30 percent by weight; (d) introducing the diluted, conditioned mineral slurry into a froth flotation cell having a central, internal, submerged impeller which comprises a base plate, to which there are attached a plurality of blades in radial arrangement, and a stationary cover plate separated from the tips of the blades by a small clearance, the impeller having a diameter which is at least three times its axial height; and (e) subjecting the conditioned aqueous mineral slurry to a pumping action in a froth flotation process in which the impeller of said froth flotation cell has a peripheral speed of at least 2,500 feet/minute and in which the aeration rate is at least 0.8 cubic feet of air per minute per cubic foot of froth flotation cell volume.

11. A process according to claim 10, wherein said fine mineral is a kaolinitic clay.

12. A process according to claim 10, wherein said fine mineral is a celestite ore.

13. A process according to claim 10, wherein said fine mineral is an apatite ore.

14. A process according to claim 1 for treating a fine mineral consisting substantially completely of particles smaller than 50 microns equivalent spherical diameter in order to separate therefrom mineral impurites, which process comprises the steps of (a) conditioning the fine mineral in the form of an aqueous slurry containing a defloccultant, the aqueous slurry having a solids content in the range 40 to 60 percent by weight, for a time sufficient to dissipate therein at least 25 horsepower hours of energy per ton of mineral solids; (b) mixing the aqueous mineral slurry before or during the conditioning thereof a collector for the mineral impurities; (c) diluting the conditioned mineral slurry to a solids content in the range 15 to 30 percent by weight; (d) introducing the diluted, conditioned mineral slurry into a froth flotation cell having a central, internal, submerged impeller which comprises a base plate, to which there are attached a plurality of blades in radial arrangement, and a stationary cover plate separated from the tips of the blades by a small clearance, the impeller having a diameter which is at least three times its axial height; and (e) subjecting the conditioned aqueous mineral slurry to a pumping action in a froth flotation process which is carried out in the absence of auxiliary carrier particles and without the use of pressurized air and in which the impeller of said froth flotation cell has a peripheral speed of at least 2,500 feet/minute and in which the aeration rate is at least 0.8 cubic feet of air per minute per cubic foot of froth flotation cell volume.

* * * * *